US009937519B2

(12) United States Patent
Chen et al.

(10) Patent No.: US 9,937,519 B2
(45) Date of Patent: Apr. 10, 2018

(54) KIT FOR ADAPTING DISPENSERS TO DISPENSE MATERIALS FROM FLEXIBLE-WALLED CONTAINERS

(71) Applicant: Franke Technology and Trademark Ltd., Hergiswil (CH)

(72) Inventors: Chi-En Chen, Vancouver (CA); Blago Lakic, Vancouver (CA)

(73) Assignee: Franke Technology and Trademark, Ltd., Hergiswil (CH)

( * ) Notice: Subject to any disclaimer, the term of this patent is extended or adjusted under 35 U.S.C. 154(b) by 41 days.

(21) Appl. No.: 15/154,859

(22) Filed: May 13, 2016

(65) Prior Publication Data

US 2017/0326580 A1 Nov. 16, 2017

(51) Int. Cl.

| | |
|---|---|
| ***B05C 17/01*** | (2006.01) |
| ***B05C 17/005*** | (2006.01) |
| ***A47G 19/18*** | (2006.01) |

(52) U.S. Cl.

CPC ..... *B05C 17/0126* (2013.01); *A47G 19/183* (2013.01); *B05C 17/00576* (2013.01); *B05C 17/00583* (2013.01)

(58) Field of Classification Search

CPC ..... B05C 17/0126; B05C 17/00576; B05C 17/00583; A47G 19/183

See application file for complete search history.

(56) References Cited

U.S. PATENT DOCUMENTS 2,138,045 A * 11/1938 Seeberger ..... B05C 17/0126 425/87
2,233,587 A * 3/1941 Crewe ..... B05C 17/0123 222/391
3,323,682 A * 6/1967 Creighton, Jr. ... B05C 17/00513 222/105
3,933,273 A * 1/1976 Cox ..... B05C 17/00583 222/1
4,373,646 A * 2/1983 MacEwen ..... B05C 17/00516 206/384
4,469,250 A * 9/1984 Evezich ..... B65D 83/0055 222/83.5
4,566,610 A * 1/1986 Herb ..... B05C 17/00516 222/137
4,966,537 A * 10/1990 Bowles ..... A23G 3/28 222/323
5,323,931 A * 6/1994 Robards, Jr. ..... B05C 17/00583 222/105
5,429,273 A * 7/1995 King ..... B05B 11/0043 222/105

(Continued)

*Primary Examiner* — Nicholas J Weiss

(74) *Attorney, Agent, or Firm* — Oyen Wiggs Green & Mutala LLP

(57) ABSTRACT

A kit for converting a gun-type sauce dispenser to dispense flowable materials such as sauces from flexible-walled containers comprises a nose piece, a dispensing tube and a supplemental piston. The nose piece has a forward end adapted to be attached to an end stop of the sauce dispenser. An opening extends axially through the nose piece. The nosepiece is adapted to be coupled to the dispensing tube such that the dispensing tube is held axially relative to the nose piece. A top sheet of a flexible-walled container may be retained between the nose piece and the dispensing tube. The nose piece may comprise a member arranged to tension the end sheet of the container.

20 Claims, 12 Drawing Sheets

(56) References Cited

U.S. PATENT DOCUMENTS 5,443,181 A * 8/1995 Popp ..... B05C 17/00576 222/137
5,634,572 A * 6/1997 Lane, Jr. ..... B05C 17/00583 222/105
6,478,190 B2 * 11/2002 Kuge ..... B65D 35/10 222/107
6,598,764 B1 * 7/2003 Stern ..... B05C 17/00583 222/105
7,775,399 B2 * 8/2010 Wood ..... B05C 17/00513 222/105
8,172,109 B2 * 5/2012 Cadden ..... B05C 17/00513 222/326
8,220,668 B2 * 7/2012 Cadden ..... B05C 17/00506 222/105
8,281,956 B2 * 10/2012 Cadden ..... B05C 17/00503 220/255
8,424,727 B2 * 4/2013 Herman ..... G01F 11/026 222/105
8,511,520 B2 * 8/2013 Van Wijk ..... B05C 17/0126 222/287
8,561,854 B2 * 10/2013 Tirone ..... A23G 3/2015 222/182
8,870,035 B2 * 10/2014 Jalali ..... A23G 3/28 222/182
8,960,502 B2 2/2015 Stehli, Jr. et al.
9,067,711 B2 * 6/2015 Melia ..... B05C 17/00583
9,114,415 B2 * 8/2015 Williams ..... B05C 17/00583
9,314,813 B2 * 4/2016 Pritchard ..... B05C 17/00583
9,694,944 B2 * 7/2017 Long ..... B65D 35/08
2002/0162859 A1 * 11/2002 Summons ..... A47G 19/24 222/142.1
2006/0065132 A1 * 3/2006 Jongen ..... B65D 83/0055 99/485
2006/0144854 A1 * 7/2006 Clemens ..... B05C 17/00516 222/94
2006/0175348 A1 * 8/2006 Wood ..... B05C 17/00513 222/94
2006/0246187 A1 * 11/2006 Egolf ..... A21C 15/005 426/116
2009/0065527 A1 * 3/2009 Buck ..... B05C 17/00576 222/95
2009/0159613 A1 * 6/2009 Rusch ..... B65D 83/0072 222/95
2009/0302055 A1 * 12/2009 Cadden ..... B05C 17/00506 222/1
2011/0006076 A1 * 1/2011 Williams ..... B05B 11/02 222/95
2013/0153600 A1 * 6/2013 Sanfilippo ..... B65D 35/30 222/95
2014/0138406 A1 * 5/2014 Sanfilippo ..... B65D 83/0072 222/95
2015/0114987 A1 * 4/2015 Pritchard ..... B65D 75/5811 222/95

* cited by examiner

KIT FOR ADAPTING DISPENSERS TO DISPENSE MATERIALS FROM FLEXIBLE-WALLED CONTAINERS

FIELD

This invention relates to apparatus useful for dispensing sauces and other flowable materials and to related methods.

BACKGROUND

In the field of high volume food production, it is common to provide dispensers which can be operated to dispense flowable materials such as sauces. For example, a dispenser may be operated to dispense a measured quantity of sauce with each squeeze of a handle. Such dispensers may be configured to dispense selected volumes of sauce. For example, one popular size of dispenser dispenses ⅓ ounce of sauce at a time.

Some sauce dispensers are of the gun-type. These dispensers dispense sauces that are packaged in cylindrical tubes. A push rod causes a piston to advance. Each time the piston is advanced, a portion of sauce is dispensed. An example of a gun-type sauce dispenser is the Franke Model 4006094 sauce dispenser gun available from Franke Foodservice Supply. Other examples include the Prince Castle Model No. 580 series sauce dispenser guns available from Prince Castle Inc. of Carol Stream, Ill., USA and the Franklin Machine Products Model No. 171-1173 sauce dispenser gun. Apart from being made from food-grade materials (such as stainless steel) these dispenser guns are similar in concept to guns used to dispense caulking and construction adhesives in the construction field.

In general, gun-type sauce dispensers dispense sauces that are packaged in stiff-walled cylindrical tubes. Some suppliers make sauces available in tubes having stiff cylindrical walls. For example the Quikspread® system available from Huhtamaki North America of De Soto, Kans. USA may be used to provide stiff-walled cartridges pre-filled with sauces of various kinds.

A disadvantage of shipping sauces in cylindrical cartridges is that the cylindrical cartridges can occupy a relatively large volume for the quantity of sauce contained in the cartridges. Another problem is the expense of providing sauces in disposable cylindrical cartridges. A further disadvantage is the difficulty in recycling the materials in disposable cylindrical cartridges.

Refillable plastic dispensing tubes are also available. A disadvantage of refillable plastic dispensing tubes is the inconvenience of filling the dispensing tubes with sauce from bulk containers as well as the labor involved in cleaning and maintaining the refillable tubes.

There remains a need for practical and efficient apparatus for dispensing sauces.

SUMMARY

This invention has a number of aspects. These include, without limitation:

- Kits for adapting sauce dispensers to dispense sauces (or other flowable materials) from flexible-walled containers. The containers may, for example, have walls made of thin plastic film that can resist tension forces but has very little stiffness;
- Gun-type sauce dispensers adapted to dispense sauces from flexible-walled containers. Such dispensers may optionally comprise a kit as described herein applied to adapt an existing sauce dispenser.
- Methods for dispensing sauces or other flowable materials contained in flexible-walled containers.

One example aspect of the invention provides a kit for converting a gun-type sauce dispenser to dispense material from flexible-walled containers. The kit comprises a nose piece and a dispensing tube. The nose piece has a forward end adapted to be attached to an end stop of the sauce dispenser and an opening extending axially through the nose piece. The nosepiece comprises overhanging member arranged to project away from the end stop (e.g. in a rearward direction relative to a travel of a piston of the sauce dispenser). The overhanging member and the dispensing tube respectively comprise first and second projecting features that, when engaged with one another, hold the dispensing tube axially relative to the nose piece.

In some embodiments the kit is used in conjunction with a sauce dispenser in which the end stop is coupled to a handle portion by a semi-cylindrical member which is dimensioned to cradle the dispensing tube when the dispensing tube is engaged to the nose piece. In some embodiments the semi-cylindrical member and the overhanging member of the nose piece together form a generally circular collar into which one end of the dispensing tube is received when the dispensing tube is engaged to the nose piece. The bottom side of the dispensing tube that contacts the semi-cylindrical member may be free of projections. For example, the bottom side of the dispensing tube may have a smooth cylindrical configuration.

In some embodiments the overhanging member comprises a half collar having an inside diameter substantially equal to an outside diameter of the dispensing tube. The first projecting feature may comprise a flange extending inwardly from the half collar.

In some embodiments the nose piece comprises first and second flange portions are arranged to grip the end stop on opposing sides of an opening in the end stop. The opening may be a centrally-located opening generally aligned with an axis along which a piston of the sauce dispenser is advanced. For example the nose piece may comprise a collar dimensioned to fit through the opening of the end stop and the flange portions may extend radially outwardly proximate a distal end of the collar. A pair of tabs may extend radially outward from the collar on opposed sides of the collar such that a forward end of each of the tabs is spaced apart from a corresponding one of the flange portions by a gap. An edge of the opening may be received in these gaps. The tabs may taper in width, being narrower at their forward ends and wider at their ends away from the corresponding gap.

In some embodiments the nose piece comprises an annular base, a collar extending forwardly from the annular base, the collar dimensioned to fit through the opening of the end stop, and flange portions extending radially outwardly at a distal end of the collar. In some such embodiments the overhanging member comprises a hemi-cylindrical collar portion extending rearwardly from an outer edge of the base. The nose piece may comprise first and second release tabs projecting radially-outwardly from the hemi-cylindrical collar portion proximate circumferentially-opposed edges of the hemi-cylindrical collar portion.

The nose piece may incorporate a feature for tensioning an end sheet of a flexible container. This feature may comprise a rim or step over which the end sheet may be stretched. In an example embodiment the feature is provided by a rearwardly-angled flange that extends around a periphery of the opening in the nose piece. For example, the nose piece may comprise a rearwardly-angled flange extending radially inwardly from an inner edge of the base in the embodiment described above. The rearwardly-angled flange is optionally interrupted by a pair of opposed cut outs. The cut outs may make the nose piece more flexible under compression in a direction perpendicular to a line extending between the cutouts. This may facilitate installation of the nose piece in the sauce dispenser. In some embodiments a line extending between centers of the flange members is generally at right angles to a line extending between the cut outs when viewed along an axis of the dispensing tube.

In some embodiments the second projecting feature comprises a circumferentially-extending bead projecting from the dispensing tube proximate one end thereof. The bead extends around not more than one half of the circumference of the dispensing tube in some embodiments.

In some embodiments the dispensing tube comprises projecting gripping features. The gripping features may be used to grip the dispensing tube in order to pivot the dispensing tube for removal from a sauce dispenser.

Beneficially the second projecting feature and the gripping features may be all on a first side of a first plane that bisects the dispensing tube longitudinally. This allows the dispensing tube to be fully seated in a sauce dispenser. The dispensing tube may be formed as a hemi-cylinder on a second side of the first plane.

The dispensing tube may be symmetrical about a second plane that bisects the dispensing tube transversely. This allows the dispensing tube to be used in either orientation. A container of sauce or other flowable material may be placed into the dispensing tube from either end in such embodiments.

A kit according to any embodiment may further include a supplementary piston having an outer diameter dimensioned to pass through the dispensing tube. The supplementary piston is adapted for attachment to a piston of the sauce dispenser. The supplementary piston can be larger in diameter than a piston of the sauce dispenser so as to provide reduced clearance between the periphery of the supplementary piston and an inner wall of the dispensing tube.

The supplementary piston may attach to the piston of the sauce dispenser in various ways. For example, the supplementary piston may include a skirt that snaps around a periphery of the piston of the sauce dispenser or the supplementary piston may be adapted to be held by a screw in front of the piston of the sauce dispenser.

Kits according to any embodiment may be used and/or provided in combination with a gun-type sauce dispenser. The sauce dispenser provides the end stop at a forward end thereof, a piston and a handle coupled to move the piston forward toward the end stop wherein the nose piece is attached to the end stop. The dispensing tube is coupled to the nose piece by way of the first and second projecting features and the piston is aligned with an axis of the dispensing tube.

A kit according to any embodiment described herein may comprise instructions for attaching components of the kit to a sauce dispenser and/or instructions for performing a method as described herein or any steps of such a method.

Another aspect provides a method comprising: affixing a nose piece to an end stop of a sauce dispenser, inserting a flexible-walled container into a dispensing tube, placing a tip of the dispensing tube under an overhanging member extending rearwardly from the nose piece, pivoting the dispensing tube into axial alignment with the nose piece and, in doing so coupling the dispensing tube to be held axially relative to the nose piece. The method may optionally include attaching a supplemental piston to a piston of the sauce dispenser.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

One aspect of this invention provides sauce dispensing apparatus which may be used to dispense sauces contained in containers, such as bags, that have highly flexible walls. Such containers have the advantage that they can be packed together for shipping with very little wasted space. Another advantage of such containers is that they may be very inexpensive as compared, for example, to pre-filled stiff-walled cylindrical cartridges. Another advantage of some such containers is that they are readily recyclable.

Figure 2:
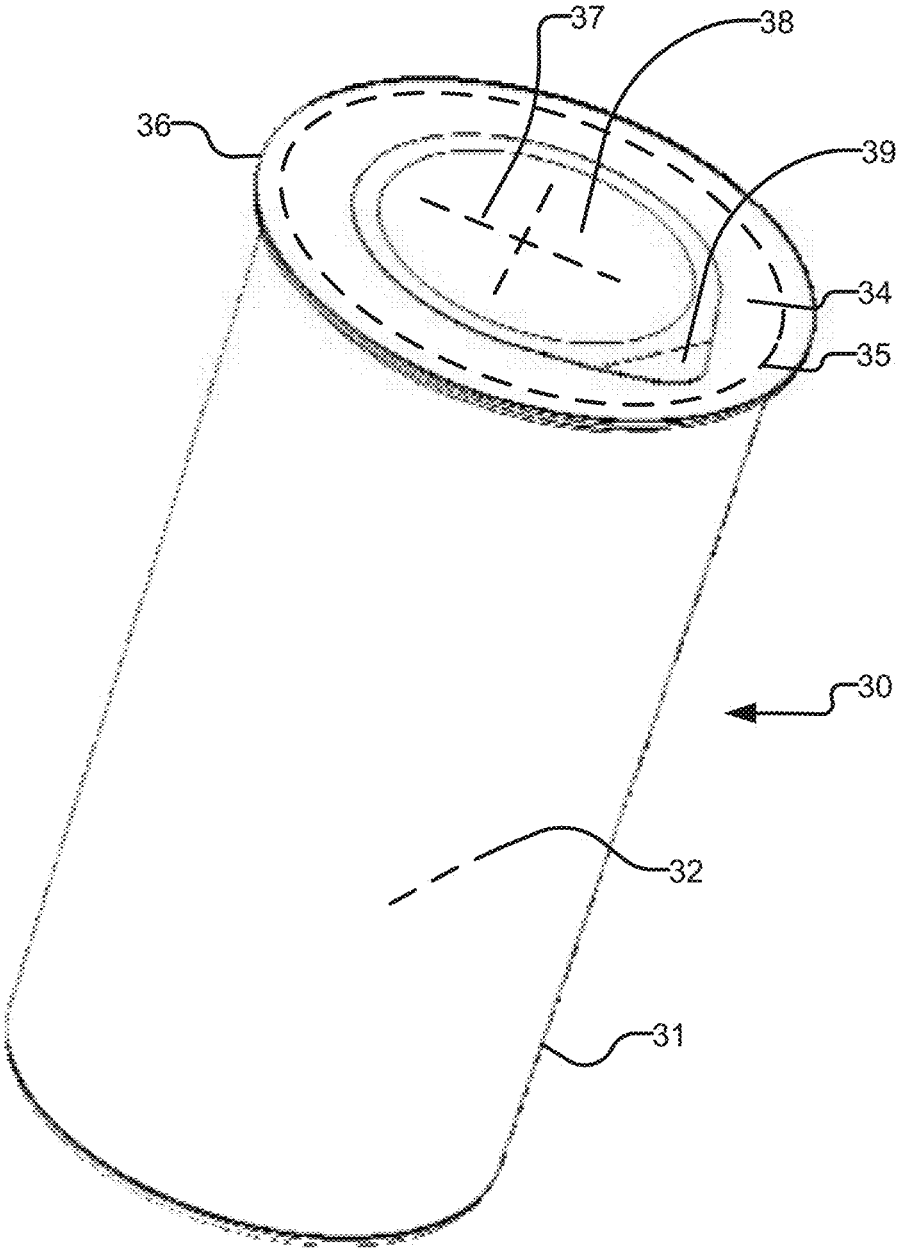
FIG. 2 is a sauce container bag according to one embodiment.
Figure 3A:
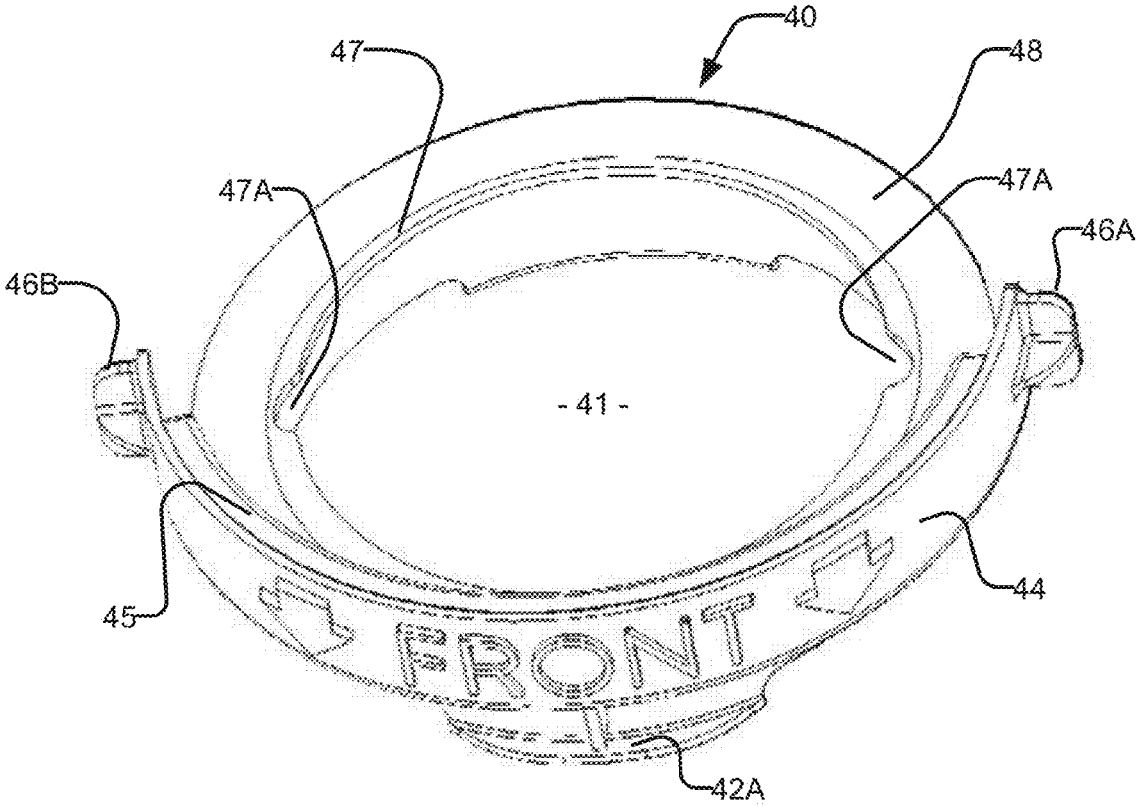
FIGS. 3A, 3B, 3C, and 3D illustrate a nose piece of the sauce dispensing apparatus of FIG. 1.
Figure 3B:
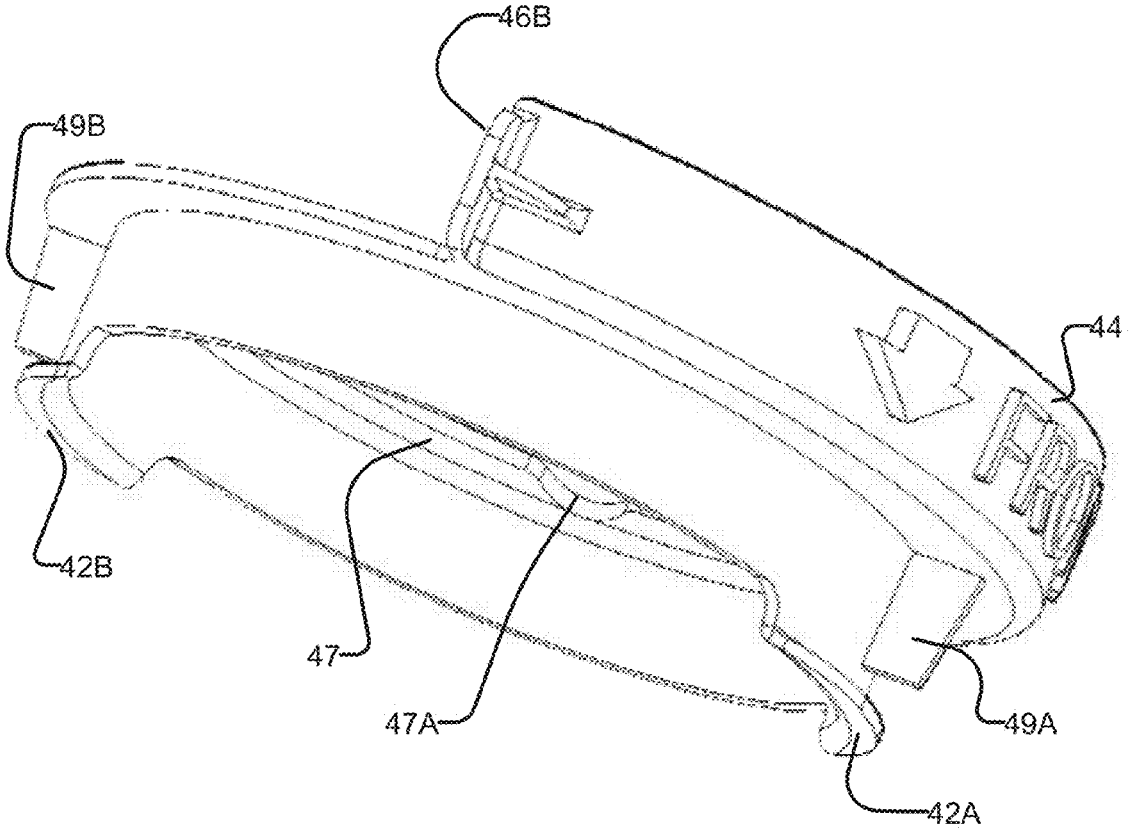
Figure 3C:
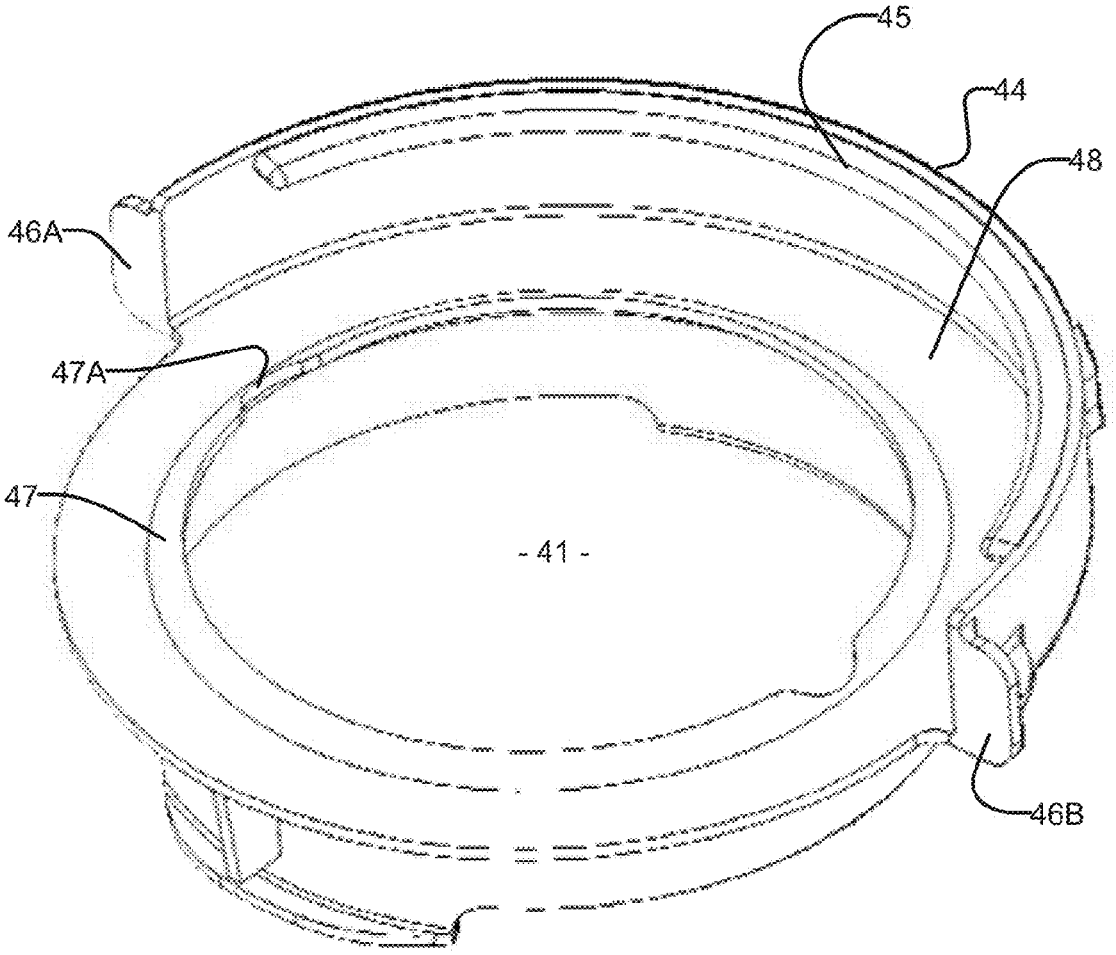
Figure 3D:
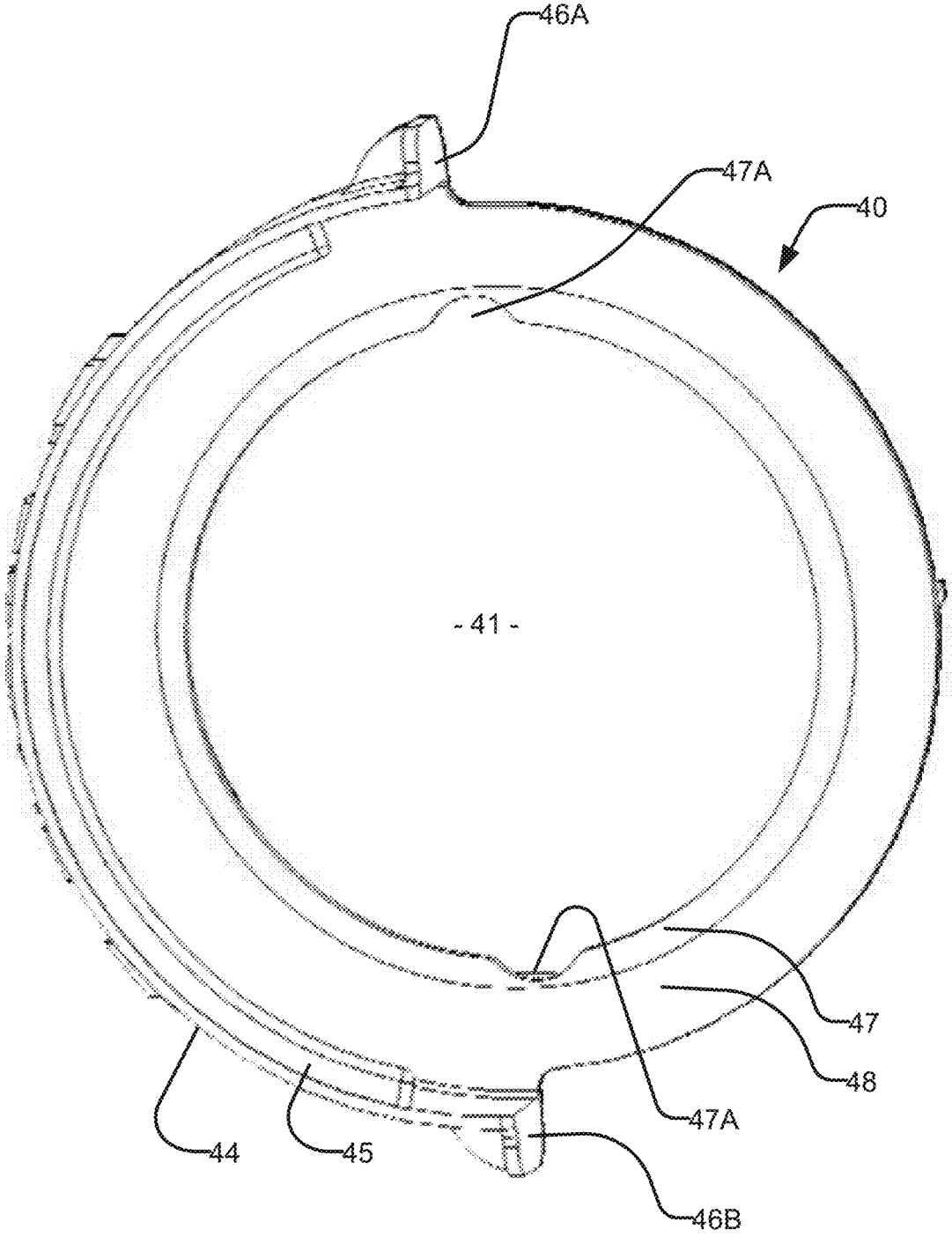

An example of a flexible walled sauce container 30 is shown in FIG. 2, which is discussed below.

Figure 1:
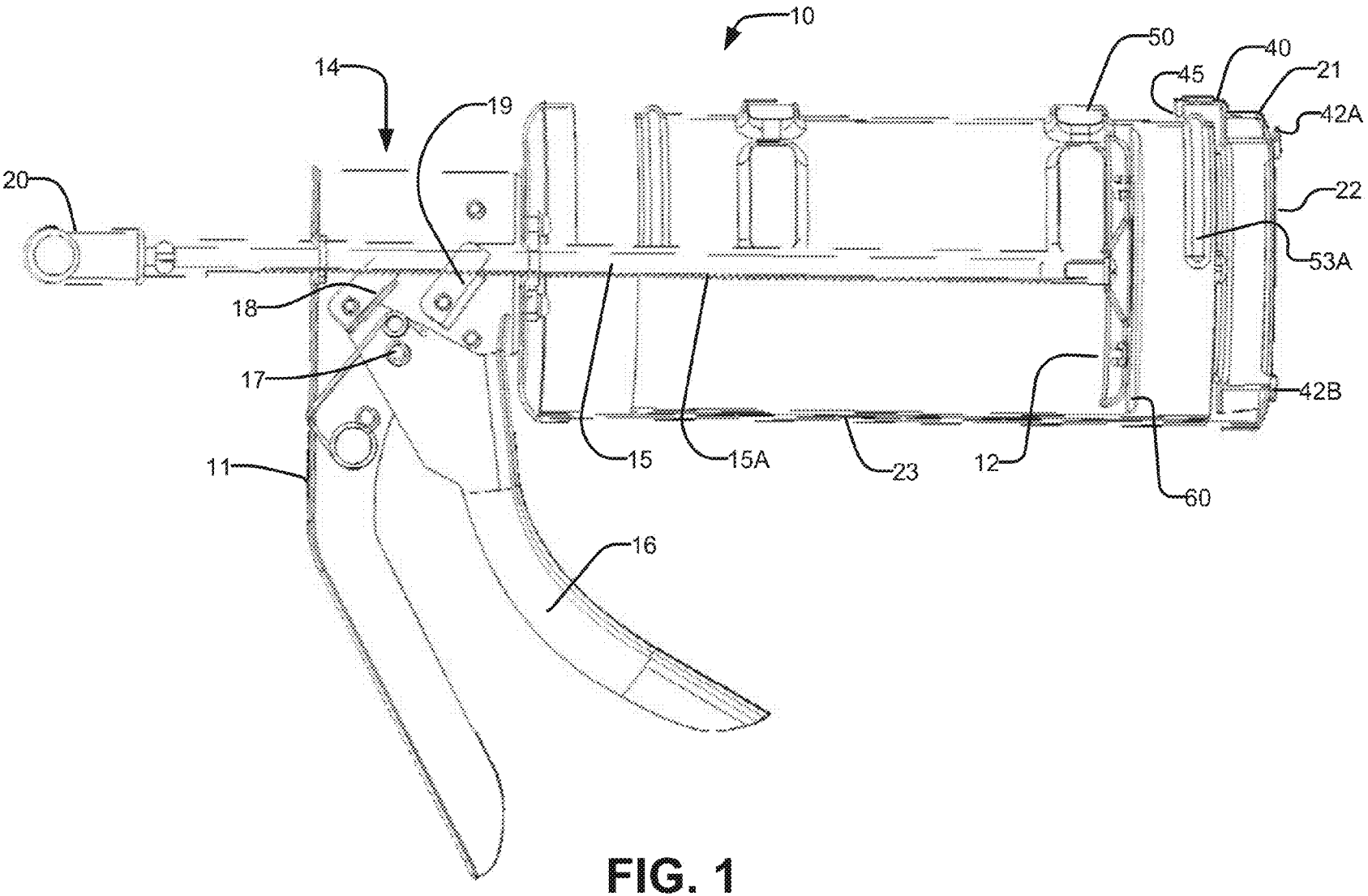
FIG. 1 shows sauce dispensing apparatus according to an example embodiment.

FIG. 1 shows apparatus 10 suitable for dispensing sauces or other flowable materials. Apparatus 10 comprises a gun-type sauce dispenser 11 that has been modified by the provision of a nose piece 40, a dispensing tube 50, and a supplementary piston 60. Apparatus 10 may be used, for example, to dispense sauces from containers 30 as shown in FIG. 2.

Gun-type dispenser 11 includes a piston 12 that may be advanced toward an end stop 21 by operation of a handle 16. End stop 21 has a central opening 22 through which sauce may be dispensed. End stop 21 is connected to handle 16 by a member 23 that sometimes takes the form of a semi-cylindrical trough.

The particular mechanism which causes piston 12 to advance as handle 16 is operated is not particularly critical. The example dispensing gun shown in FIG. 1 uses a ratchet mechanism 14 for this purpose. Sauce dispensing gun 11 may be a prior art or other commercially available sauce dispensing gun, for example, a Franke™ sauce dispenser gun.

In the illustrated embodiment, piston 12 is mounted at one end of a push rod 15. Push rod 15 is formed to have a rack of teeth 15A along one side thereof. When handle 16 is squeezed, handle 16 pivots around a pivot point 17 to cause a pawl 18 to engage teeth 15A and advance push rod 15. When handle 16 is released, it returns to its initial position by pivoting about axis 17. A second pawl 19 prevents push rod 15 from slipping backward. Piston 12 may be retracted by releasing pawls 18 and 19 while pulling back on handle 20.

In its unmodified form, sauce dispenser 11 may be used to dispense sauces from pre-filled cylindrical cartridges dimensioned to fit against end stop 21. One example of such cartridges is the Huhtamaki™ cartridges mentioned above. Such cartridges may include plungers which are driven by the advance of piston 12 to expel sauce from the cartridges.

In the illustrated embodiment, sauce dispenser 11 has been modified by the addition of a nose piece 40 and a dispensing tube 50. These components allow the use of sauce dispenser 11 to dispense sauces from highly flexible containers, for example containers 30 as shown in FIG. 2.

Sauce container 30 shown in FIG. 2 comprises a flexible walled body 31. The material of body 31 is highly flexible. For example, body 31 may comprise a thin plastic film. Body 31 may be formed to have a cylindrical shape when filled. For example, body 31 may be formed from a sleeve of thin plastic. Body 31 may be formed, for example, by drawing a sheet of thin plastic into a deep cup shape. Body 31, when placed in tension by the pressure exerted by contained sauce, may form a circle having a diameter selected to match the internal diameter of dispensing tube 50 such that body 31 can be slipped inside dispensing tube 50 to substantially fill the cross-section of dispensing tube 50. Body 31 may have a length substantially equal to or shorter than a length of dispensing tube 50.

A front end of container 30 comprises an end sheet 34 which may be bonded to body 31 at a seam 35 leaving an outwardly-projecting flange 36. Seam 35 may, for example, be formed by heat sealing after body 31 has been filled with sauce. End sheet 34 is formed with weaknesses and/or openings through which sauce can be dispensed. For example, end sheet 34 may be formed with cross hair slits 37 through which sauce may be dispensed. End sheet 34 may, for example, comprise a plastic sheet. A sealing cover 38 having a pull tab 39 covers dispensing features 37. Container 30 may, for example, be constructed as described in U.S. Pat. No. 8,960,502 which is hereby incorporated herein by reference for all purposes.

Because the walls of container 30 are formed of very flexible film-like materials, a filled container 30 may deform when stacked together with other filled containers 30 in a shipping carton or other shipping container so that there is very little wasted space between them.

In preparation for use, nose piece 40 is installed onto end stop 21. Nose piece 40, once installed, may be left in place on sauce dispensing gun 11. A sauce dispenser apparatus 10 as illustrated in FIG. 1 may be used to dispense sauce from a flexible-walled container 30 by sliding body 31 of container 30 into a dispensing tube 50 with the dispensing tube 50 removed from apparatus 10. Flange 36 of container 30 may extend around one end of dispensing tube 50.

With piston 12 in its fully retracted position, dispensing tube 50 and the enclosed flexible-walled container 30 are inserted into gun 11 and dispensing tube 50 is engaged with nose piece 40. When dispensing tube 50 is moved into place in dispensing apparatus 10, flange 36 is trapped between one end of dispensing tube 50 and nose piece 40. Before or after dispensing tube 50 is installed into apparatus 10, cover 38 may be removed by grasping and pulling tab 39 to expose dispensing features 37.

Subsequently, sauce dispensing gun 11 may be operated to dispense sauce from the flexible-walled container 30 by squeezing handle 16, thereby causing push rod 15 to advance piston 12 along dispensing tube 50. In the illustrated embodiment, sauce dispenser 11 has been equipped with a supplementary piston 60.

Each of nose piece 40, dispensing tube 50 and supplementary piston 60 are discussed in more detail below.

Nose piece 40 is shown in FIGS. 3A through 3D. Nose piece 40 includes flange portions 42A and 42B that provide tabs dimensioned to hold nose piece 40 in position on end stop 21 of dispensing gun 11. This may be achieved, for example, by tilting nose piece 40 relative to end stop 21 and hooking flange portion 42B through opening 22 and over the edge of end stop 21. Nose piece 40 can then be slightly deformed to permit flange portion 42A to be been pushed through opening 22 so that flange portion 42A is also hooked over the edge of end stop 21. Constraining ribs 49A and 49B engage the inner surface of end stop 21 such that nose piece 40 is axially fixed relative to end stop 21.

Constraining ribs 49A and 49B engage the inner surface of end stop 21 such that nose piece 40 is axially constrained relative to end stop 21. Constraining ribs 49A and 49B are tapered to facilitate inserting nose-piece 40 at an angle into opening 22 for installation and removal.

Nose piece 40 is dimensioned to allow enough transverse 'free play' between nose piece 40 and end stop 21 to account for the possibility that different specimens of any particular model of sauce dispenser 11 may have dimensions that vary within manufacturing tolerances and also to facilitate easy installation and removal of nose piece 40. The fit of nose piece 40 to end stop 21 is tight enough that nose piece 40 is not easily knocked out of sauce dispenser 11 during normal use.

In restaurant service, gun-type sauce dispensers are often stored by dropping them into holders. End stop 21 may be impacted as a sauce dispenser is dropped into a holder. Flange portions 42A and 42B preferably lie flat against the outer face of end stop 21 so that when apparatus 10 is dropped on end, flange portions 42A and 42B will not be popped out of position.

Nose piece 40 may be removed easily for cleaning by pulling or pushing release tabs 46A and 46B in a direction parallel to the central axis of gun-type sauce dispenser 11.

Nose piece 40 has a central opening 41 through which sauces may be dispensed. Nose piece 40 includes a member operable to engage dispensing tube 50. This member may project rearwardly and may overhang dispensing tube 50 when dispensing tube 50 is installed. In the illustrated embodiment, this member is provided by a curved plate 44 that bears one or more inwardly-facing projections. In the illustrated embodiment, the projection comprises an inwardly-projecting flange portion 45. Flange portion 45 is spaced apart from a bearing surface 48 to define an opening dimensioned to receive a projection from dispensing tube 50.

Most commercially available gun-type sauce dispensers have relatively little clearance between piston 12 and members (e.g. member 23) that extend longitudinally to support end stop 21. For example, some commercially-available sauce guns are designed so that there is only about 1 mm of clearance between the outer wall of the sauce tube and the inner wall of the semi-cylindrical metal plate that connects end stop 21 to the handle of the gun-type sauce dispenser.

For this reason, curved plate 44 extends only part way around nose piece 40. For example, curved plate 44 may extend for less than 180 degrees around the circumference of nose piece 40. Flange portion 45 (or a series of projections that may be provided as an alternative to flange portion 45) may also be provided only on one side of nose piece 40. In the illustrated embodiment, curved plate 44 and flanged portion 45 are disposed of on only on one side of nose piece 40.

An angled flange 47 extends inwardly from surface 48. End sheet 34 of a container 30 may be stretched across flange 47. This stretching causes end sheet 34 to be held taut. This, in turn provides a more rigid support for dispensing features 37 which, in turn helps to achieve a consistent and acceptable dispense pattern.

Flange 47 is optionally interrupted by gaps, cutaways or notches 47A located on either side of opening 41 in a plane between flange portions 42A and 42B. Gaps 47A improve the flexibility of nose piece 40. This facilitates installation of nose piece 40 in a sauce dispenser 11.

Nose piece 40 may be made from any suitable material. In some embodiments, nose piece 40 is made of a suitable plastic material such as polypropylene or a similar plastic material. For example, nose piece 40 may be made by injection molding.

Figure 4A:
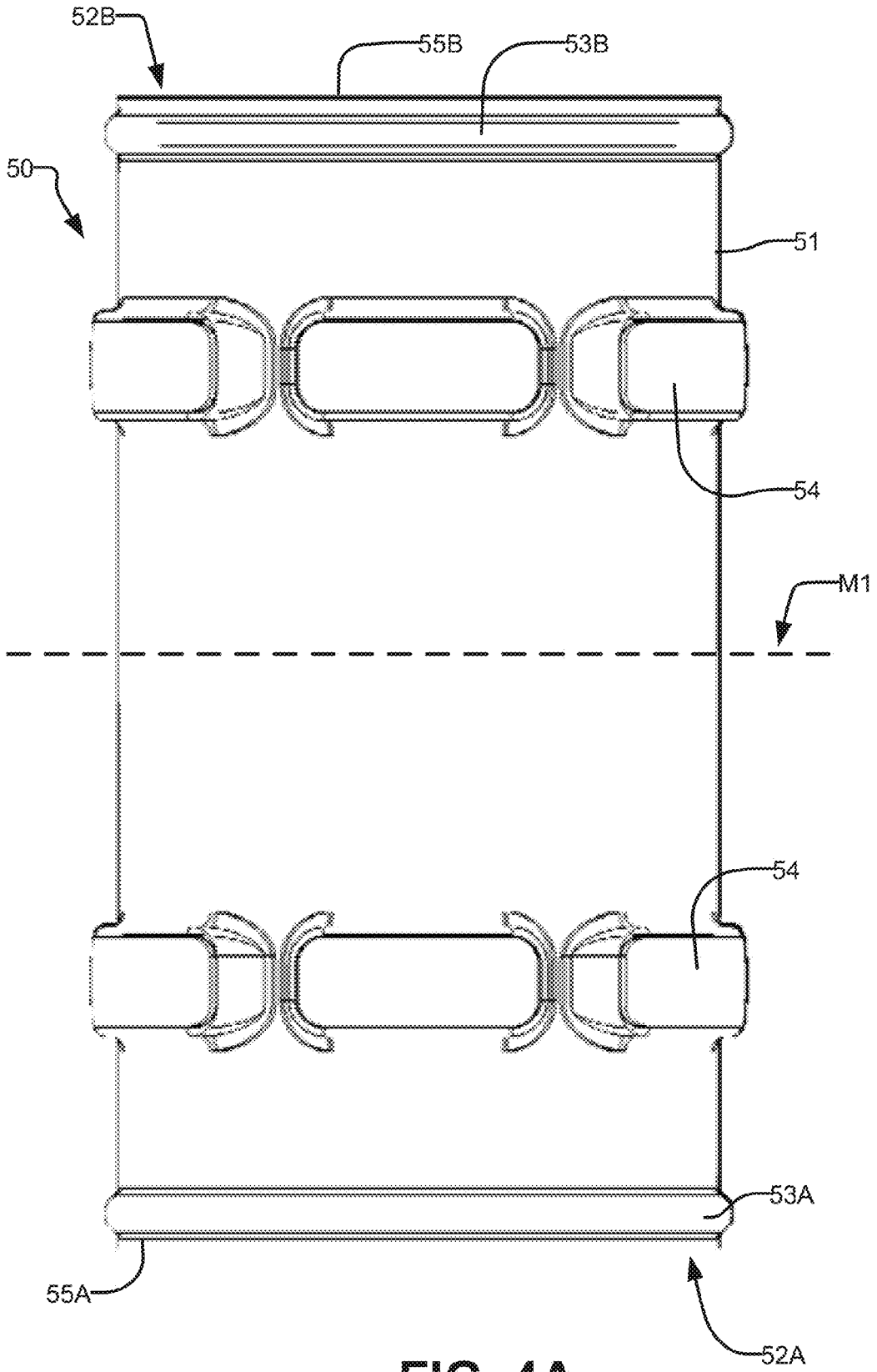
FIGS. 4A, 4B, and 4C illustrate a dispensing tube of the sauce dispensing apparatus of FIG. 1.
Figure 4B:
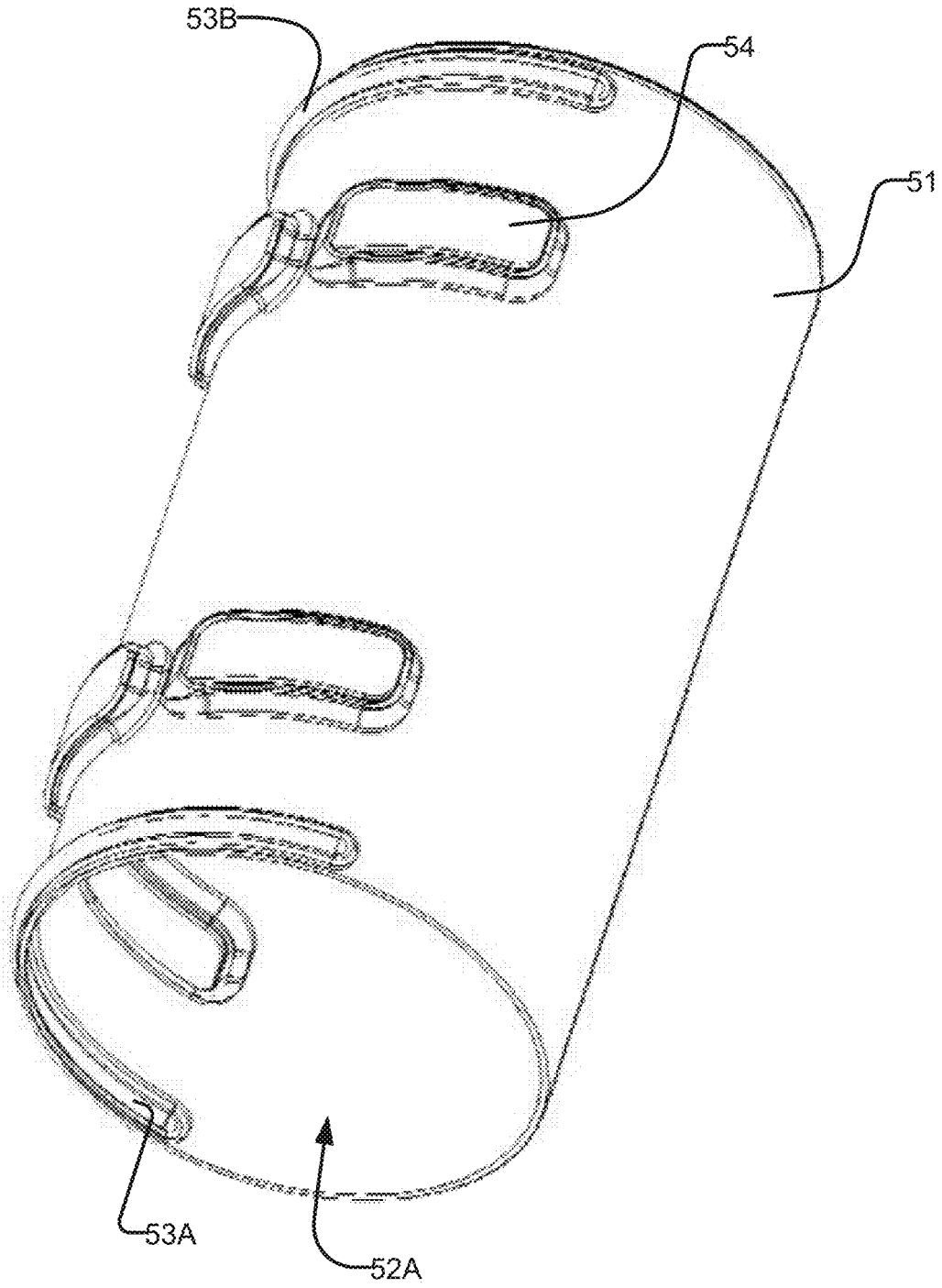
Figure 4C:
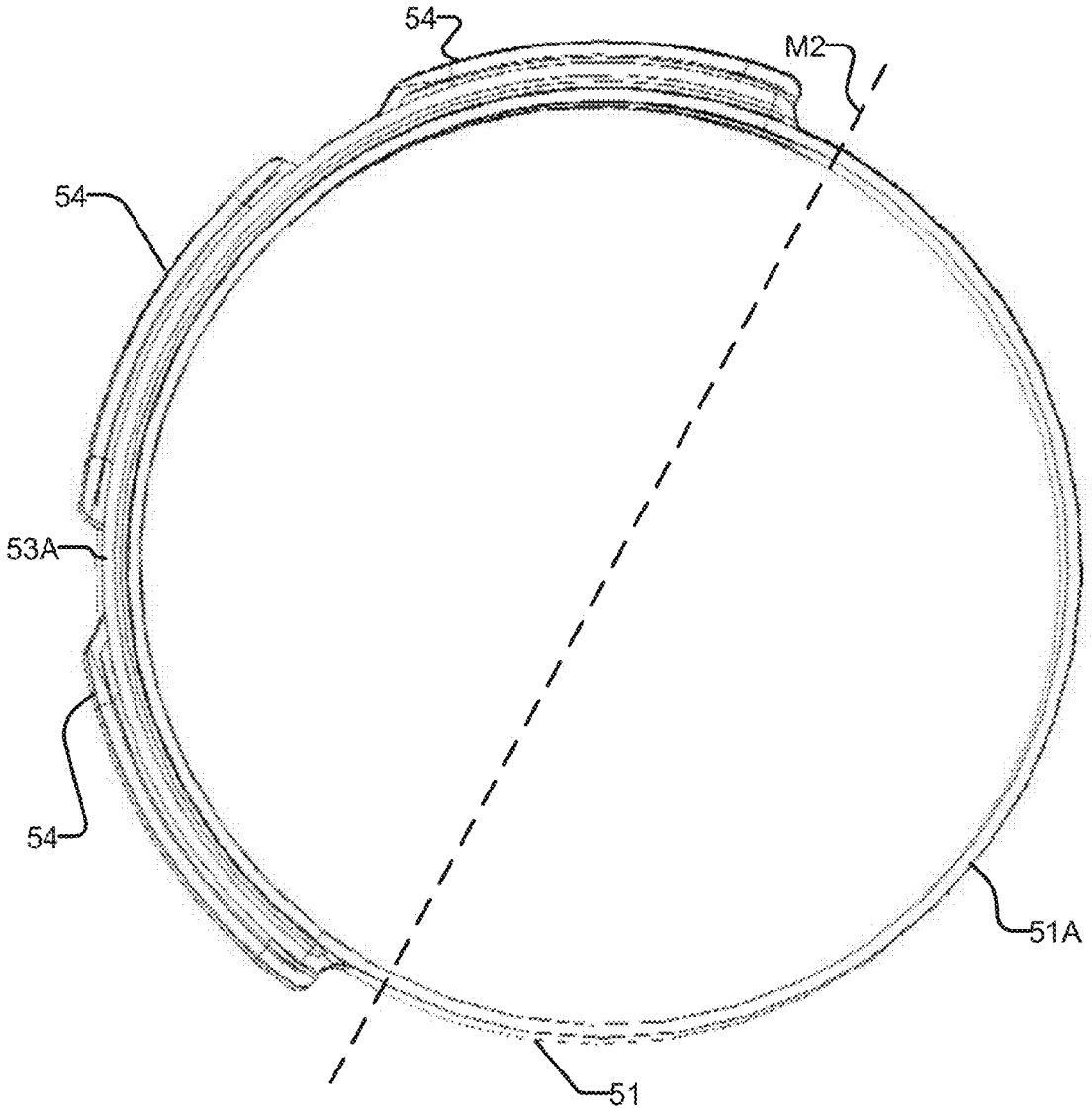

An example dispensing tube 50 is illustrated in FIGS. 4A through 4C. Dispensing tube 50 has open ends 52A and 52B. A bead 53A is provided adjacent to end 52A. As shown in FIG. 1, bead 53A may be engaged under member 45 of nose piece 40 so as to hold dispensing tube 50 in place relative to nose piece 40. The engagement between dispensing tube 50 and features of nose piece 40 may provide an interference fit. This engagement can keep the flange 36 of a container 30 held securely between edge 55A and surface 48. When this happens, end sheet 34 of a container 30 is stretched over flange 47 such that the dispensing features 37 are aligned do dispense sauce through opening 41 and end sheet 34 is held taut.

Engagement of dispensing tube 50 to nose piece 40 prevents dispensing tube 50 from moving axially relative to nose piece 40 in a way that could expose container 30 or allow some part of container 30 to extrude out or fall out between dispensing tube 50 and nose piece 40 when apparatus 10 is in use.

The illustrated dispensing tube 50 also has features 54 to assist a user in removing dispensing tube 50 from a gun type sauce dispenser 11 and to help the user grip the dispensing tube 50. In the illustrated embodiment, features 54 comprise bumps or protrusions on the outer surface of dispensing tube 50. Gripping features could additionally or in the alternative comprise holes or depressions that can be gripped by a user's fingers.

Because most commercially available gun-type sauce dispensers have relatively little clearance between piston 12 and members (e.g. member 23) that extend longitudinally to support end stop 21, bead 53A extends only part way around dispensing tube 50. For example, bead 53A may extend for less than 180 degrees around the circumference of dispensing tube 50. Other features such as bead 53B and features 54 may also be provided only on one side of dispensing tube 50. In the illustrated embodiment, beads 53A, 53B and features 54 are all disposed on only one side of a longitudinal mid-plane M2.

Dispensing tube 50 may conveniently be made by blow molding. In some embodiments, dispensing tube 50 is made of a lightweight plastic. For example, dispensing tube 50 may comprise polypropylene, polyethylene or a similar plastic material.

In the illustrated example, dispensing tube 50 is symmetrical about a transverse mid-plane M1. In particular, beads 53A and 53B are provided at either end of dispensing tube 50 and mirror-image sets of features 54 are provided. This is convenient because such a dispensing tube 50 can be used in any orientation. It is not necessary that a container 30 be inserted in any particular end. However, such symmetry is not mandatory. Other embodiments may have a bead 53A or other feature for engagement with nose piece 40 only on one end and/or may provide only one set of grip features 54 and/or asymmetrically-placed grip features 54.

As an alternative to or in addition to projecting grip features 54, finger holes (not shown) may be formed in the wall of dispensing tube 50.

Commonly-available sauce dispensers 11 are typically designed for use in conjunction with sauce container cartridges that include built-in plungers. These plungers may have the form of shallow plastic cups that are pushed along dispensing cartridges by piston 12. For use with pre-filled sauce cartridges equipped with such plungers, piston 12 may be significantly smaller in diameter than the plungers. Dispensing tube 50 may have the same inside diameter as the cartridges that a particular gun-type sauce dispenser is designed for such that the sauce dispenser will deliver the same volume of sauce whether it is used with a flexible-walled container in a dispensing tube 50 as described herein or with a pre-filled sauce dispensing cartridge. Consequently, it is typically the case that piston 12 is considerably smaller in outside diameter than the inside diameter of dispensing tube 50.

Figure 1A:
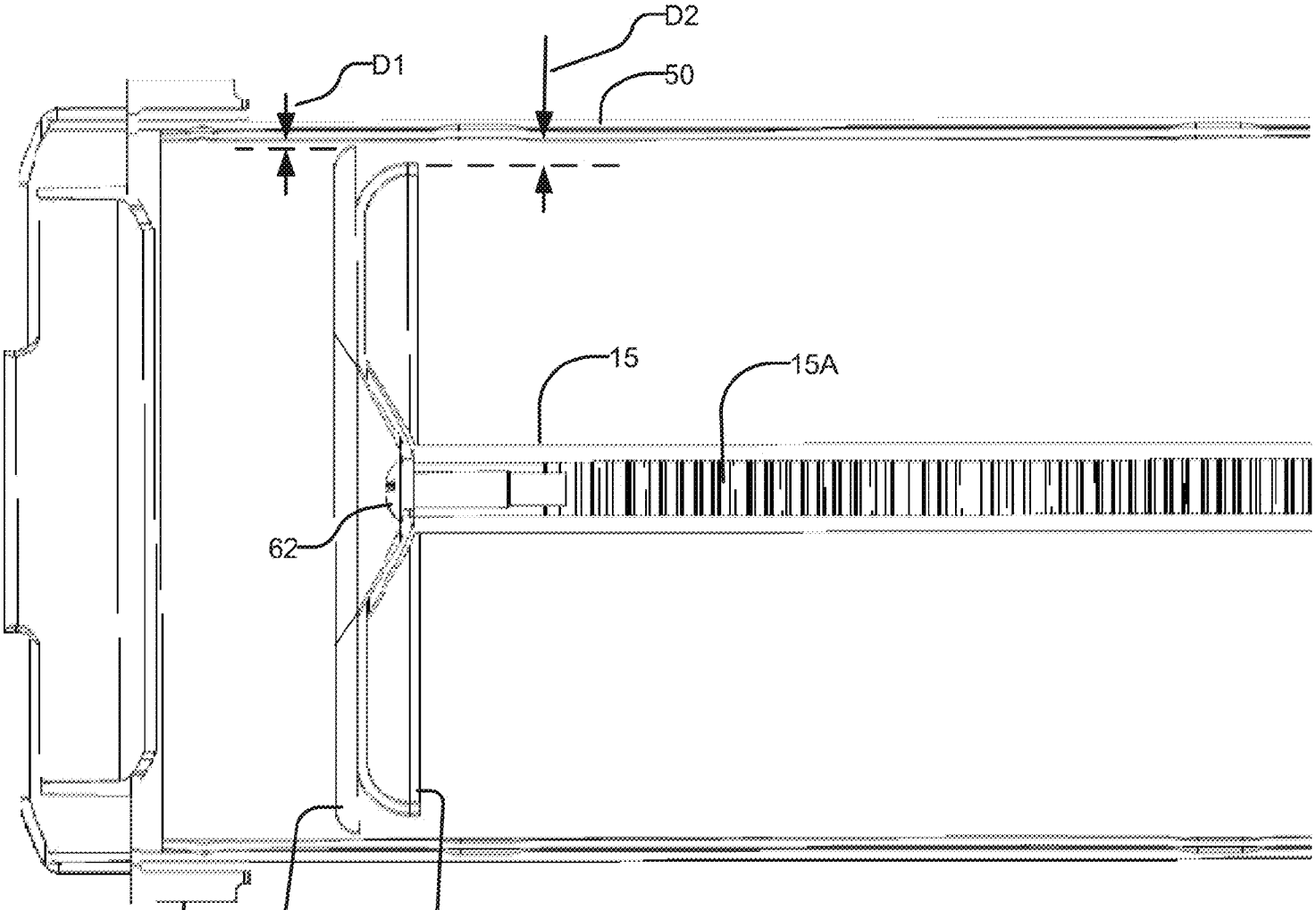
FIG. 1A is an expanded cross-section view of a portion of the sauce dispensing apparatus of FIG. 1.

Some embodiments provide a supplementary piston 60 which provides reduced clearance with the inner diameter of dispensing tube 50. This is illustrated in FIG. 1A. In FIG. 1A, the clearance between piston 12 and the inside diameter of dispensing tube 50 is D2. A piston expander 60 is mounted in front of piston 12. Supplementary piston 60 may be larger in diameter than piston 12 such that the clearance between supplementary piston 60 and the inside diameter of dispensing tube 50 is D1, with D1<D2. Supplementary piston 60 may be less stiff than piston 12 because most of the surface area of supplementary piston 60 is supported from behind by piston 12.

Figure 1B:
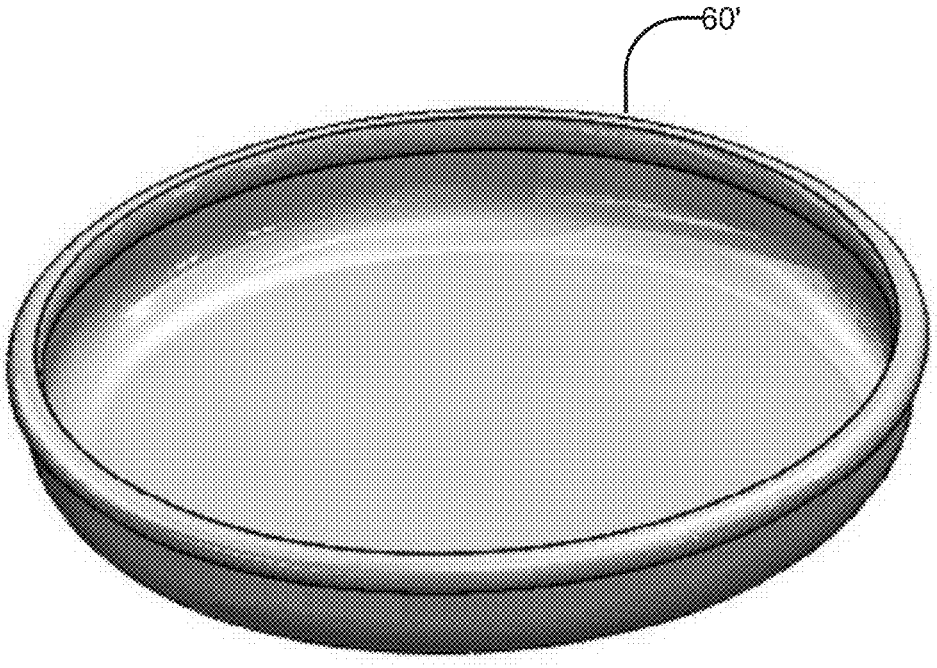
FIG. 1B is a perspective view of a supplementary piston according to one embodiment.

In the embodiment shown in FIG. 1A supplementary piston 60 is mounted by a screw 62 which also holds piston 12 in place. FIG. 1B shows an alternative supplementary piston 60' designed to snap on over top of a piston 12. In other alternative embodiments, instead of retaining piston 12 and adding a supplementary piston 60, piston 12 is replaced with a larger diameter piston 12 that is sized to provide only a small amount of clearance D1 with the inside diameter of dispensing tube 50.

A supplementary piston 60 or 60' may, for example be made by injection molding. The supplementary piston may be made, for example, from polypropylene or a similar plastic material.

Apparatus 10 as depicted in FIG. 1 may include as sauce dispenser 11 an off-the-shelf commercially available sauce dispenser which has been modified to support dispensing sauces from containers of the general type shown in FIG. 2. Parts 40, 50 and optionally 60 may be provided in the form of a kit. The kit may include instructions for assembling nose piece 40 to an existing gun type sauce dispenser and for using the dispensing tube 50 included in the kit to support a flexible-walled container 30 as sauce or other flowable material is being dispensed from the container 30.

Alternative embodiments provide sauce dispensers which are purpose built for dispensing sauces and other flowable materials from compliant-walled containers such as containers 30.

For example, the nose piece may be held in place by latching onto a gun-type dispenser end stop. In some embodiments, this may be achieved, by tilting the nose piece relative to the end stop and hooking a nose piece flange portion through an end stop opening and over the edge of the end stop. The nose piece may then be compressed so that a second nose piece flange portion may be hooked through the end stop opening and over the edge of the end stop. In some embodiments, the nose piece may comprise nose piece 40 described above.

Figure 5:
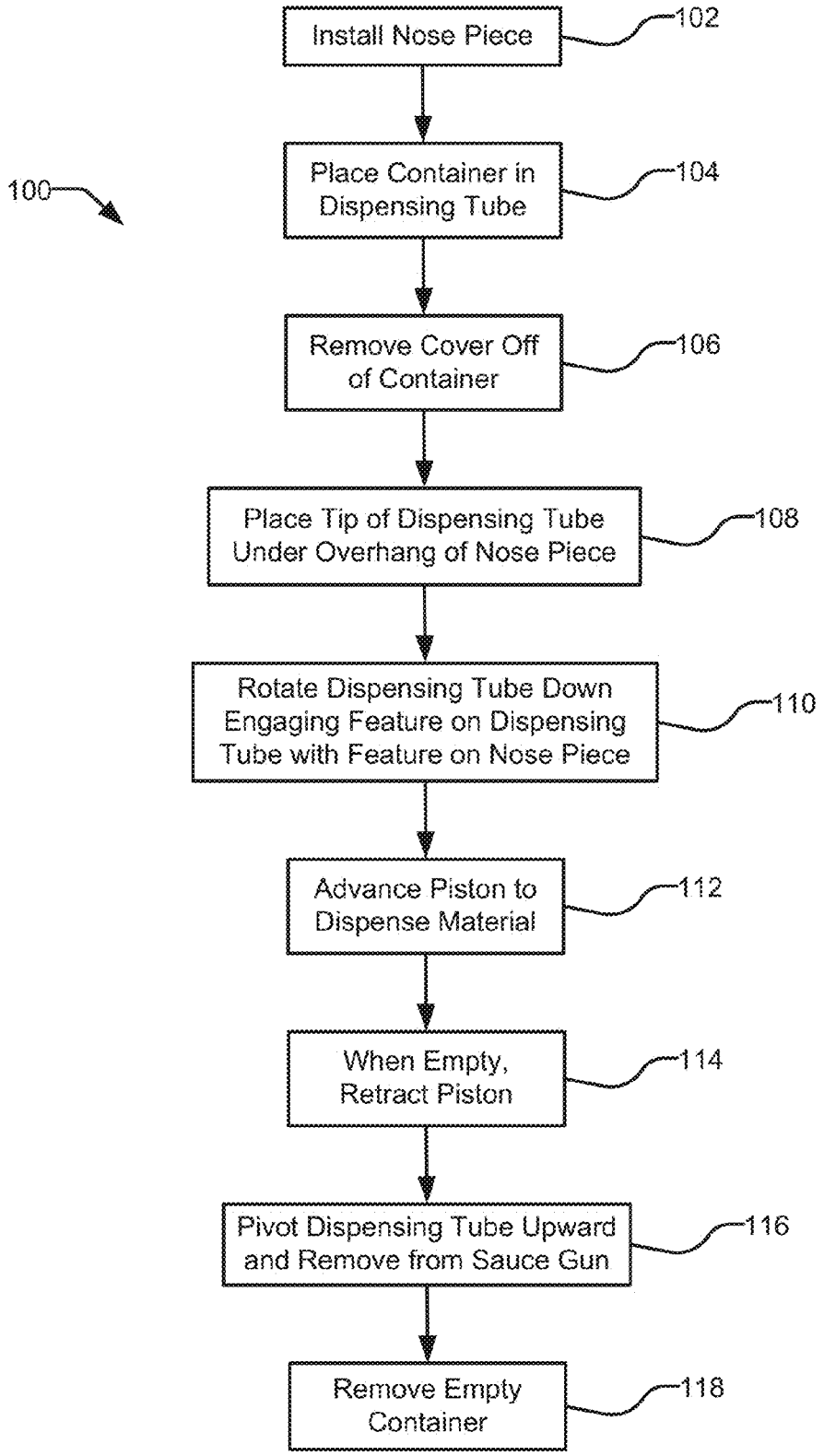
FIG. 5 is a flow chart illustrating an example method for dispensing a flowable material.

FIG. 5 illustrates an example method 100 for dispensing sauces or other flowable materials. At block 102, a nose piece is installed into a gun-type dispenser. In some embodiments, the nose piece is held in place by latching onto an end stop of the gun-type dispenser. The end stop may have a central aperture and the nose piece may include members that grip the end stop by reaching around an edge of the central aperture. In some embodiments, installing the nose piece may comprise tilting the nose piece relative to the end stop and hooking a nose piece flange portion through an end stop opening and over the edge of the end stop. The nose piece may then be compressed so that a second nose piece flange portion may be hooked through the end stop opening and over the edge of the end stop. For example, the nose piece may comprise tabs 42A and 42B that hook over edges of the end stop on either side of the central aperture. In some embodiments the nose piece comprises a nose piece 40 as described above.

A container is placed into a dispensing tube at block 104. In some embodiments, the container includes an end face that has a peripheral part that projects outwards past an inner wall of the dispensing tube. For example, the peripheral part may be like flange 36 described above. The container may be placed into the dispensing tube such that the peripheral part overlaps and extends around one end edge of the dispensing tube.

At block 106, a cover is removed from the container. For example, the cover may be removed by pulling a tab to expose dispensing features.

A tip of the dispensing tube is placed under an overhanging part of the nose piece at block 108. For example, the dispensing tube tip may be placed such that a protrusion that extends outwardly from the dispensing tube near the tip is under the overhanging part of the nose piece. Where the nose piece is like nose piece 40, for example, the tip of the dispensing tube may be placed under curved plate 44. In some embodiments, the dispensing tube feature comprises a circumferentially-extending projection such as bead 53A as described above.

At block 110, the dispensing tube is pivoted about its tip and rotated downward. The downward rotation engages a dispensing tube feature with a nose piece feature. For example, a dispensing tube feature may be engaged under an inwardly-facing projection from the overhanging part of the nose piece so as to hold the dispensing tube in place axially relative to the nose piece. Since the nose piece is engaged to the end stop the dispensing tube is also held in place axially relative to the end stop. In an example embodiment the dispensing tube may comprise bead 53A described above and the inwardly-facing projection may comprise flange portion 45 described above.

Engagement between the dispensing tube and nose piece may provide an interference fit. For example, the bead or other feature projecting from the dispensing tube may be deformed slightly by the engagement.

Engaging the dispending tube to the nose piece may clamp a container end sheet between a forward edge of the dispensing tube and a surface of the nose piece. In some embodiments, when this engagement happens, a container end sheet may be stretched over rearward-facing projections from the surface of the nose piece located radially inside of the forward edge of the dispensing tube. This can hold the container end sheet taut with container dispensing features aligned with an opening through the nose piece. For example, the rearwardly-facing projections may be provided by flange 47 described above. Container dispensing features may comprise dispensing features 37 described above.

Sauce, or other flowable material, is dispensed by advancing a piston at block 112. For example, the piston may be advanced by squeezing a gun-type dispenser handle.

A piston of the dispenser is retracted once the container is empty at block 114. In some embodiments, the piston may be retracted by releasing a ratchet mechanism while pulling back on a handle. For example, the piston may be retracted by releasing pawls 18 and 19 described above, while pulling back on handle 20 described above. Upon retraction of the piston, the rear end of the dispensing tube can be pivoted upward and the dispensing tube removed from the sauce gun at block 116. The empty container is removed from the dispensing tube at block 118.

Method 100 may include an optional block of installing a supplementary piston onto a piston of the sauce dispenser or replacing a piston of the sauce dispenser with a larger piston prior to block 108.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. Except when otherwise stated or implied, 'forward' is a direction in which a piston of a sauce dispenser advances when sauce is dispensed and rearward is the opposite direction. The subject matter described herein may assume various alternative orientations. Accordingly, these directional terms are not strictly defined and should not be interpreted narrowly.

"Hemi-cylindrical" or "semi-cylindrical" refer to the form of one half of a cylinder that has been bisected longitudinally.

Where a component (e.g. a handle, flange, projection, assembly, piston, plunger etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A kit for converting a gun-type sauce dispenser to dispense material from flexible-walled containers, the kit comprising:

a. a nose piece having a forward end adapted to be attached to an end stop of the sauce dispenser, an opening extending axially through the nose piece; and b. a dispensing tube;

the nose piece comprising an overhanging member arranged to project away from the end stop, the overhanging member and the dispensing tube respectively comprising first and second projecting features that, when engaged with one another, hold the dispensing tube axially relative to the nose piece.

2. The kit according to claim 1 wherein the overhanging member comprises a half collar having an inside diameter substantially equal to an outside diameter of the dispensing tube.

3. The kit according to claim 2 wherein the first projecting feature comprises a flange extending inwardly from the half collar.

4. The kit according to claim 1 wherein the nose piece comprises first and second flange portions arranged to grip the end stop on opposing sides of an opening in the end stop.

5. The kit according to claim 4 wherein the nose piece comprises a collar dimensioned to fit through the opening of the end stop and the flange portions extend radially outwardly at a distal end of the collar.

6. The kit according to claim 5 comprising a pair of tabs extending radially outward from the collar on opposed sides of the collar, a forward end of each of the tabs spaced apart from a corresponding one of the flange portions by a gap.

7. The kit according to claim 6 wherein the tabs taper in width, being narrower at their forward ends and wider at their ends away from the corresponding gap.

8. The kit according to claim 1 wherein the nose piece comprises an annular base, a collar extending forwardly from the annular base, the collar dimensioned to fit through the opening of the end stop, and flange portions extending radially outwardly at a distal end of the collar.

9. The kit according to claim 8 wherein the overhanging member comprises a hemi-cylindrical collar portion extending rearwardly from an outer edge of the base.

10. The kit according to claim 9 wherein the nose piece comprises first and second release tabs projecting radially-outwardly from the hemi-cylindrical collar portion proximate circumferentially-opposed edges of the hemi-cylindrical collar portion.

11. The kit according to claim 8 wherein the nose piece comprises a rearwardly-angled flange extending radially inwardly from an inner edge of the base.

12. The kit according to claim 11 wherein the rearwardly-angled flange is interrupted by a pair of opposed cut outs.

13. The kit according to claim 11 wherein a line extending between centers of the flange members is generally at right angles to a line extending between the cut outs when viewed along a longitudinal axis of the dispensing tube.

14. The kit according to claim 1 wherein the second projecting feature comprises a circumferentially-extending bead projecting from the dispensing tube proximate one end thereof.

15. The kit according to claim 14 wherein the bead extends around not more than one half of the circumference of the dispensing tube.

16. The kit according to claim 8 wherein the dispensing tube comprises projecting gripping features.

17. The kit according to claim 16 wherein the second projecting feature and the gripping features are all on a first side of a first plane that bisects the dispensing tube longitudinally.

18. The kit according to claim 17 wherein the dispensing tube is formed as a hemi-cylinder on a second side of the first plane.

19. The kit according to claim 18 wherein the dispensing tube is symmetrical about a second plane that bisects the dispensing tube transversely.

20. The kit according to claim 1 further comprising a supplementary piston having an outer diameter dimensioned to pass through the dispensing tube, the supplementary piston adapted for attachment to a piston of the sauce dispenser.

* * * * *